US006009648A

United States Patent [19]

Tijanic

[11] Patent Number: 6,009,648

[45] Date of Patent: Jan. 4, 2000

[54] DISPLAY DEVICE AND ARRAY

[75] Inventor: Veso S. Tijanic, Etobicoke, Canada

[73] Assignee: Mark IV Industries Limited, Mississauga, Canada

[21] Appl. No.: 09/150,045

[22] Filed: Sep. 9, 1998

[51] Int. Cl.[7] ..... G09F 9/30

[52] U.S. Cl. ..... 40/449; 40/442; 40/447; 336/180; 336/200; 336/232; 336/223; 361/801; 361/807; 361/809

[58] Field of Search ..... 361/801, 807, 361/809, 805, 767, 777; 336/180, 200, 232, 223; 40/449, 442, 447

[56] References Cited

U.S. PATENT DOCUMENTS

| | | | |
|---|---|---|---|
| 4,075,591 | 2/1978 | Haas | 336/200 |
| 4,201,965 | 5/1980 | Onyshkevych | 336/180 |
| 4,577,427 | 3/1986 | Browne | 40/449 |
| 5,521,573 | 5/1996 | Inoh et al. | 336/180 |
| 5,600,908 | 2/1997 | Hogberg | 40/449 |
| 5,627,563 | 5/1997 | Nakagiri et al. | 345/111 |
| 5,809,675 | 9/1998 | Tijanic et al. | 40/449 |

*Primary Examiner*—Leo P. Picard
*Assistant Examiner*—David Foster
*Attorney, Agent, or Firm*—Robert L. Westell

[57] ABSTRACT

A changeable display element is edgewise mounted on an insulating board and carries to rotate through about 180° to show one color face or the other to a viewer. The board provides a similarly colored face for each face to form a pixel. The element carries a permanent magnet and is driven by a switchable magnetic field provided from the board. Soft iron pads on the board cooperates with the magnet on each position to retain the element against incidental displacement between application of the field. The board may support arrays of such elements.

12 Claims, 4 Drawing Sheets

DISPLAY DEVICE AND ARRAY

Figure 1:
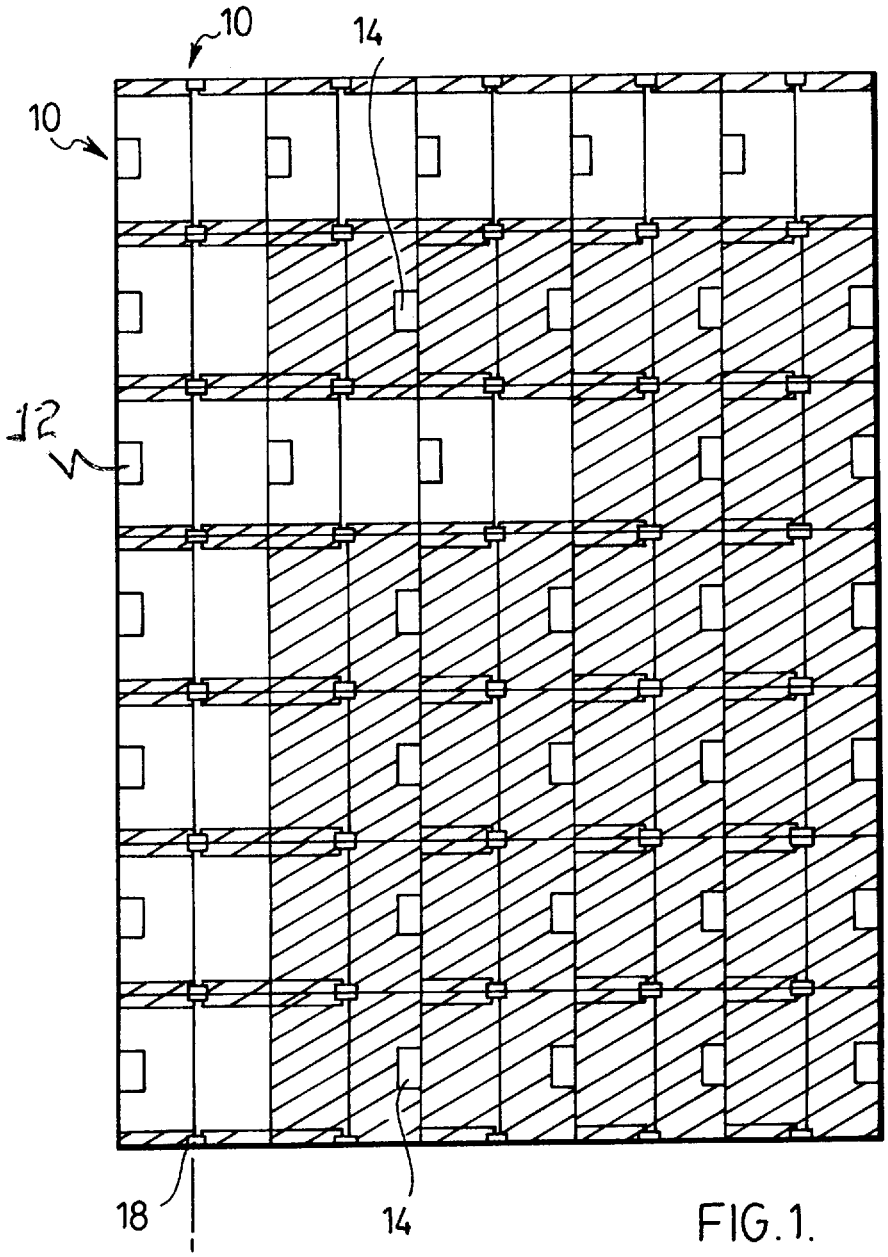

This invention relates to a display element and to an array thereof, wherein a disk mounting a permanent magnet may be electromagnetically driven by magnetic field forming members between ON and OFF positions in which positions, opposite disk surfaces of contrasting appearance are displayed in a viewing direction.

Opposite disk surfaces of contrasting appearance are usually bright and dark. Where the application speaks of bright and dark surfaces it is understood that this is not meant to exclude contrasting appearances of a different description.

What is referred to as a permanent magnet herein will retain its magnetism under the operating conditions of the disk on which it is mounted. The sense of the permanent magnet may however be 'set' in the factory by production equipment.

Other magnetic materials have high or low remanent flux in the absence of a field, often respectively referred to in the prior art as hard and soft magnets, respectively. Hard magnets of high remanent flux may be switched in flux more easily than what is called a permanent magnet. In most display elements, and in distinction from the present invention, there is a static drive core of hard magnetism switched by pulses in a solenoid coil. However with the magnetic drive of this invention there is no such core associated to maintain magnetic flux in the absence of a pulse. Thus, in this invention, in the absence of a hard magnetic core, the field produced to drive the disk between ON and OFF positions must be maintained from the start of disk movement until the disk has substantially reached its destination position.

In many prior art display elements the disk mounted to rotate on an axis or swing on an axis approximately parallelling the plane of the disk has substantial areas on each side of the axis. However, in accord with this invention, the disk is located substantially all on one side of the rotary or swingable axis. Thus the disk is substantially edge mounted. With such a disk there is an ON side usually of bright colour and an OFF side, often dark. The area across the pivot axes from the ON side of the disk when displayed in the viewing direction forms a similarly colored approximate mirror image of the disk ON side when viewed in the viewing direction, so that the disk ON side and the mirror image area, together form a pixel. Conversely, in the OFF position, the disk has rotated approximately 180 to display the OFF side and the pixel is filled with a similarly colored portion of the board which is a mirror image of the disk OFF side.

In prior designs, the disk was mounted on a housing (which could be combined with other housings in an array on a board), and driven by a cored coil where the core was of high remanence and could be switched by a pulse in the coil.

In the design of commonly owned application Ser. No. 08/851,889 filed May 6, 1997, the high remanence (hard iron) core is mounted on an insulator board, preferably a printed circuit board (PCB) whose surface was treated to provide a spiral conducting path, surrounding the core location which path carried the necessary current to pulse the core to switch its polarity. The display element rotor carrying a permanent magnet, and housing were mounted on the PCB.

In this invention, the housing field is produced by currents on a path or paths formed on the surfaces of one or more layers of a board, preferably a PCB. However no core is provided. The housing field produced by the path in the absence of a core drives the rotor disk between ON and OFF positions which respectively provide ON and OFF faces visible in an intended viewing direction. The sense of the housing field is determined by the current direction along the path. The disk is driven by the housing field because it carries a permanent magnet forming the rotor field with a major component transverse to the median plane of the disk.

The disk is, preferably as nearly as practically possible, edge mounted on a rotary axis transverse to the viewing direction. An edge mounted disk leaves visible in the viewing direction one half the width of the pixel. The disk moves between an ON and an OFF position, which are on opposite sides of the disk axis from each other. The board mounts a path, preferably spiral, which with the energizing current produces the ampere turns required to produce the stator field to move the disk between ON and OFF positions. The housing field polarity is in a sense determined by the direction of current flow. Such path may be of several extents, series connected on different layers. Soft iron pads mounted on the board and located to correspond to each of the ON and OFF positions magnetically couple to the magnet in the disk adjacent either ON or OFF position to latch it and retain it, against moderate forces tending to dislodge it from whichever ON or OFF position it was last moved to. Thus in distinction to the cored arrangement of application Ser. No. 08/851,889, in application Ser. No. 08/851,889 the switching process energizing current must be maintained for the extent of time required to detach the disk from one pad and to move the disk into magnetic coupling with the opposite pad. (The field, and hence the current may be applied intermittently but the duration of the force corresponds to the duration of the current and both must continue long enough to maintain the momentum of the disk to move between the pads corresponding to the ON and OFF positions in the sense to move from one pad to a coupling relationship to the other pad.)

The board may be composed of several layers if required and the housing field may be produced by path extents located on a number of layers and connected in series in the proper sense.

The disks and their corresponding approximate mirror image pixel areas are customarily arranged to cover the board for the area of the array. Thus the pixel areas will preferably be those which have a high 'packing factor' to occupy a large proportion of the area such as a square pixel and a half-square disk, edge mounted, at a right bisector of the pixel. Other area shapes will be those which pack well in the bound array area and allow the edge mounting of a disk on the axis of symmetry for the area.

The array may be written on and erased in accord with the control of flow in the current paths according to techniques well known to those skilled in the art.

By 'board' herein is meant a relatively flat board of (preferably) dielectric material commonly used to mount circuits, or circuit components, and is here used to receive the stator coils. Preferably, the board is a PCB.

The housing coil is a path formed on the layer or layers of a board.

In accord with this invention an insulating board is provided with conducting paths, preferably flat coils, formed on a surface thereof which paths act as a turn or a series of turns about a point. The final insulating board may be a lamination of a number of sub layers of such boards if the number of turns requires more turns than can be conveniently placed on one surface. The conducting paths are arranged to produce at a pixel, a housing field with a major component normal to the board in a sense determined by the direction of current flow on the path. A 'flat coil', so called to differentiate it from the usual helical coils, may be prefabricated on a surface of the insulating board or its layers. Hence the step of winding is eliminated. A flat coil of more than one turn is preferably a spiral which need not be geometrically regular. The number of turns on any one surface is limited by the fact that there is a limit for spiral size set when the outer turns do not have a successful magnetization effect.

With this invention the cost of a module or array in comparison to separate housings is reduced since the board may be prefabricated with an array of pixel positions which may be used to achieve the arrangement of the display elements in a module or array.

Figure 2:
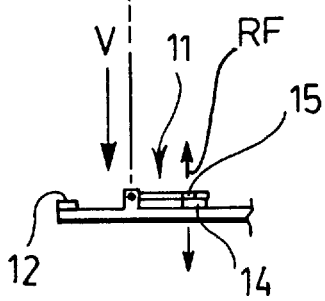
Figure 3:
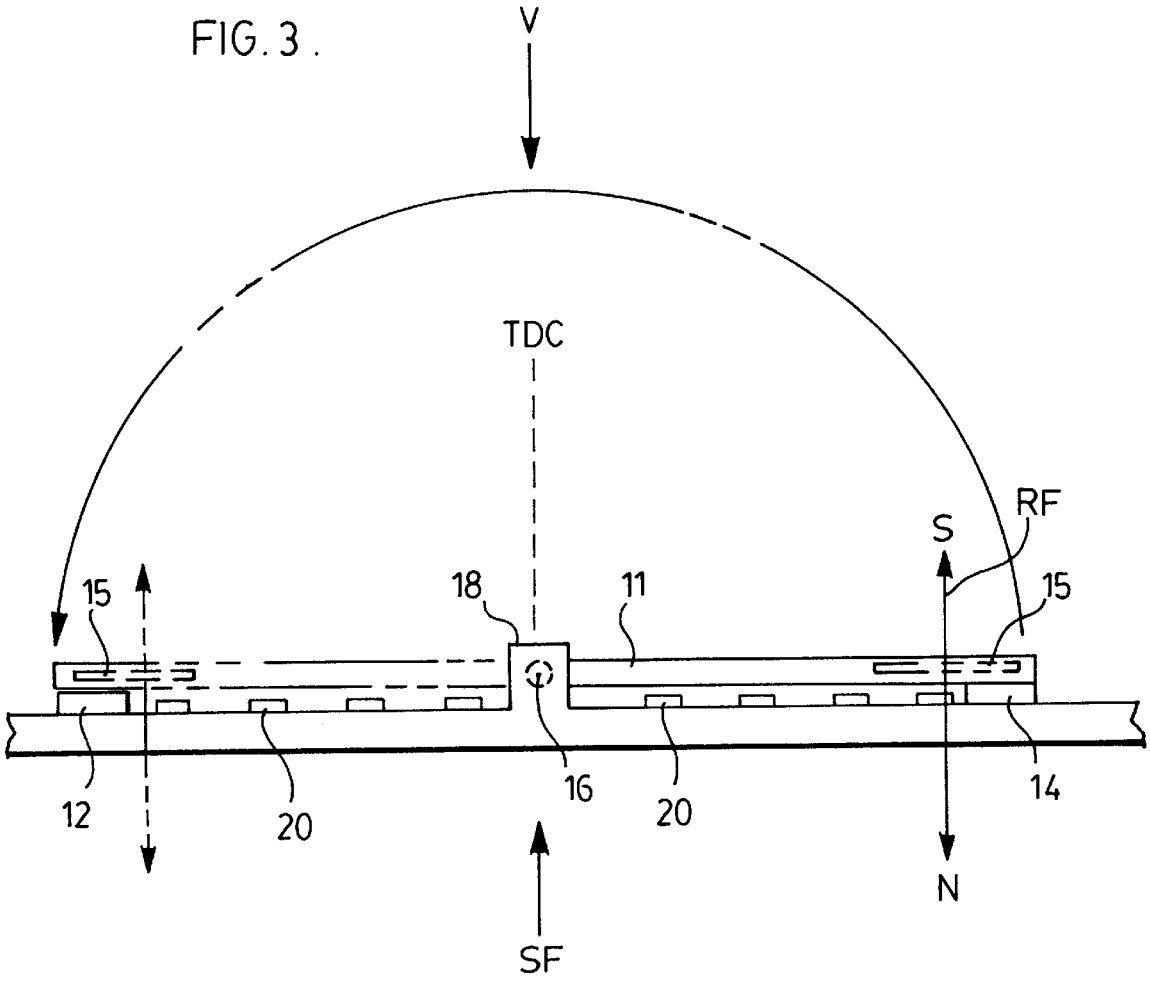

In drawings which illustrate an embodiment of the invention:

FIG. 1 illustrates a sub array having 7 rows and 5 columns made up of pixels in accord with the invention, FIG. 2 is a sectional view along the rotation axis of a disk, FIG. 3 is an enlarged sectional view of the pixel and disk along the rotation axis and showing the ON position in solid line and the OFF position in dotted line.

Figure 4:
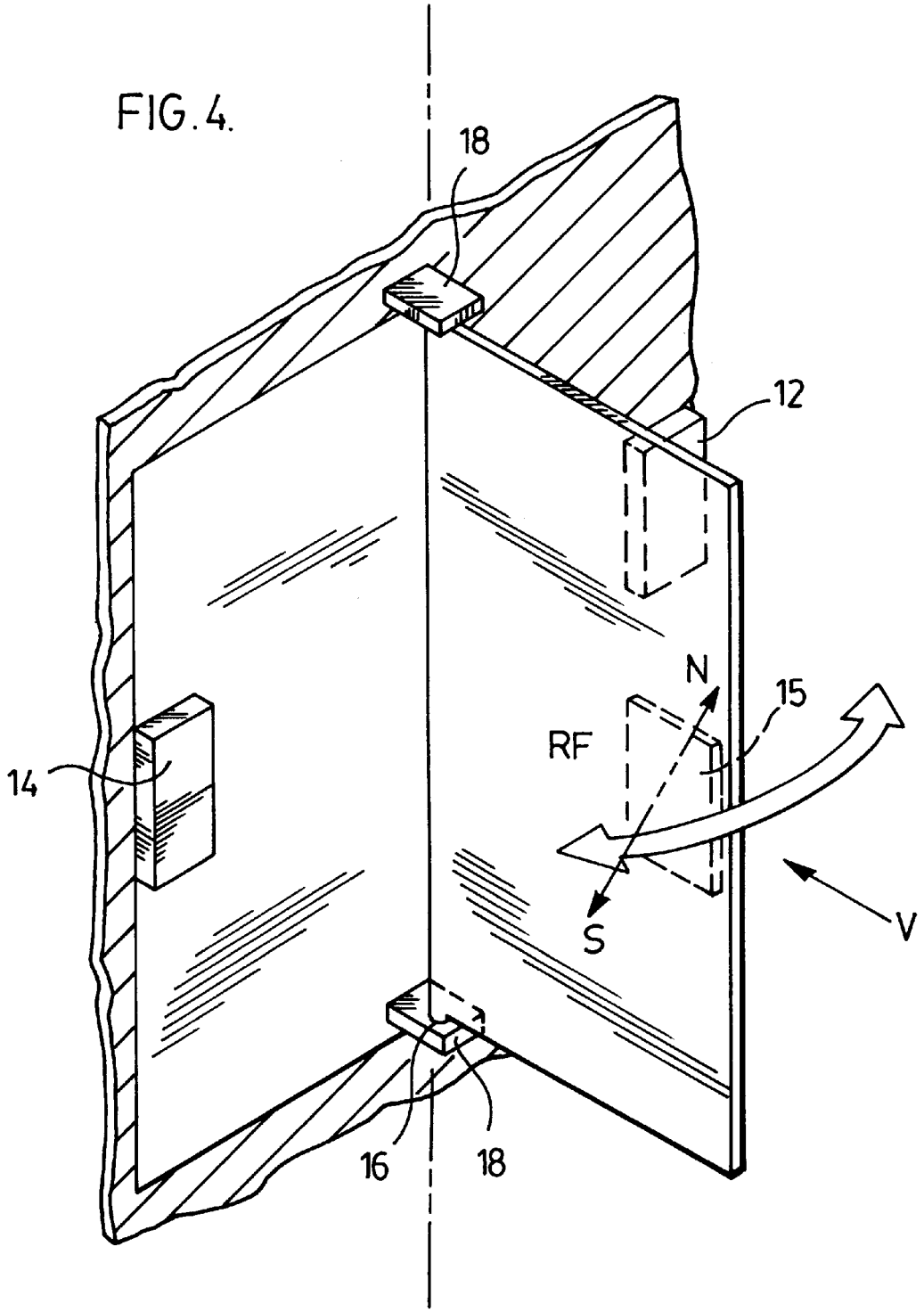
Figure 5:
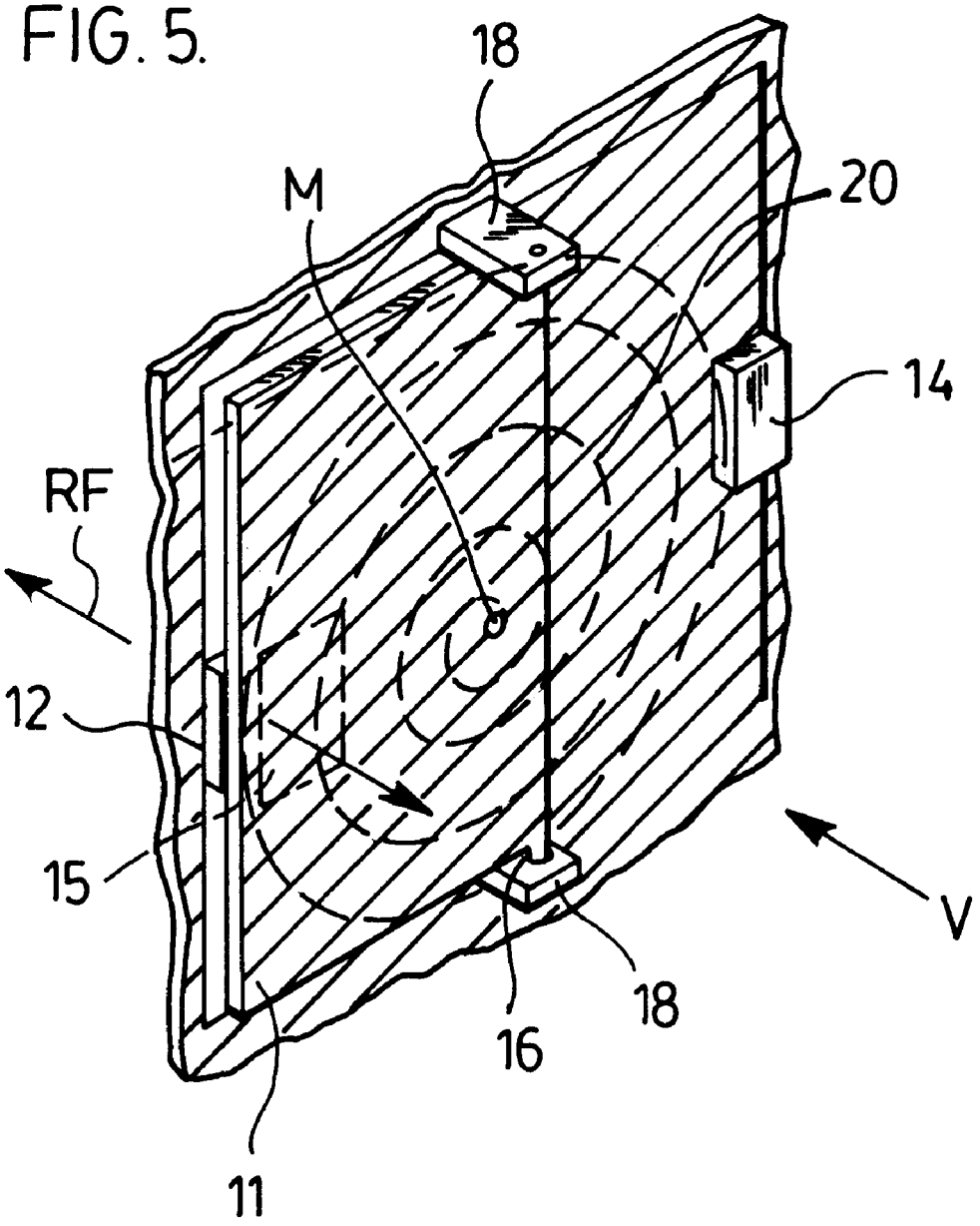

FIG. 4 is a perspective view of a disk and a PCB portion forming a pixel, with the disk between ON and OFF positions, FIG. 5 is a of the disk and a PCB area in OFF position, The word 'spiral' is used to define the preferred shape of a conducting path designed to produce a housing flux field to influence the disk. The path does not have to be a known geometric spiral shape but may be of a basic curvature as shown or a hexagonal shape or another shape, where the path increases or decreases in diameter with azimuthal angle but must cumulatively produce the desired field sense for the direction of current flow along the path. If there is a single path per pixel then the overall effect of the path must be concave toward the position M or the board of the desired field maximum. There may be sub layers with spirals connected in series in the same sense. In plan there may be a single spiral (acting as a monofilar winding) for a pixel as shown in FIG. 4. There could be two spirals (not shown) in similar spirals alternating along a radius of the spiral and acting as a bifilar winding in the same sense as desired to achieve between ON and OFF switching. (Moreover the energization in the path or paths may be constant for travel between ON and OFF or intermittent. If intermittent the 'current on' periods should be chosen so that momentum of the disk is maintained from when it leaves on limiting position, until its magnet 10 couples to the soft iron magnet near the other limiting position.

In FIG. 1 is shown, in plan, the sub-module of an arrangement with 7 rows and 5 columns. As reference to FIGS. 2–5 will also show, preferably square pixels are arranged to edge mount a half-square disk 11 pivoted along the median of the square. In general the pixel may define any area with an axis of symmetry.

In FIGS. 2–5 it is shown that each pixel 10 carries a soft iron pad 14 to magnetically couple to the permanent magnet 15 of the disk when the latter is in ON position with its bright side showing in the viewing direction V. FIGS. 2–5 show that each pixel 10 carries a second soft iron pad 12 to magnetically couple to permanent magnet 15 on the disk when the latter is in the viewing direction V.

In FIG. 1 the outlines of permanent magnets 15 and an indication of the paths are omitted for clarity. A 5 column, 7 row sub array of pixels 10 forms an "F". The viewing direction V is toward the plane of the board in FIG. 1.

The board is typically a PCB. The board may comprise a number of sub layers.

FIGS. 2–5 show that the disk is pivoted to the board in the simplest way possible, such as with spindles 16 inserted through ears 18 mounted on the PCB. The pivot may be of any other design where the disk is swingably related to the plate for (approximate) 180 rotation.

As shown in FIG. 3 the magnet 15 may be embedded in the disk. The magnet is magnetized transversely to the rotary axis. Alternatively the disk itself may be the magnet itself.

Viewed transverse to the PCB (the viewing direction) there is preferably one spiral per pixel per PCB layer. Put in another way a single coil (which may have a number of layers) is preferably used to move the disk in both directions between ON and OFF positions. The magnetic axis is transverse to the disk which disk in each of the ON and OFF positions is substantially parallel to the PCB.

The spiral path of conductor 20 is patterned to use a large proportion of the pixel area. The turns forming the spiral path on a layer are preferably as close to each other as possible without creating a risk of short circuits. The illustration in the application is not to scale.

Any variety of pivot or swingable mounting may be used and the disk may be pivoted or swingably mounted for example to the board itself.

'Swingable' herein includes pivoted and also connection where the pivotal motion is combined with a small translation of the pivotal axis.

Thus for the purpose of FIGS. 2–5 the ears 18 conductor 20 and the part of the board associated with each pixel may be considered as the housing for each such pixel.

In most prior flip disk operations a hard magnetic core is pulsed to switch the disk in either sense between ON and OFF positions. Thus the pulse may be very short relative to the time for the mechanical movement of the disk. However in the instant device and in the absence at a core, the energization of the winding must continue for the period for mechanical movement from the start (one of ON or OFF) position to the point at which the disk approaches close enough that the permanent magnet 10 makes effective magnetic coupling with the soft iron pad 12 or 14 of the destination position.

In operation then, assuming a disk is static in OFF position, (FIG. 5 and the dotted line position of FIG. 3), there is no current in winding 20 and the disk, is held in OFF position by the magnetic coupling between the permanent magnet 15 and the low remanence iron pad 12. The OFF (here assumed dark) position of the pixel is indicated to the viewer through the disk dark or OFF side and pixel surface dark side.

When it is desired to switch the pixel to ON to display its bright face in the viewing direction then the coil 20 is energized (from current source and switching means not shown) to provide current flow to produce a field to repel the disk in the OFF position causing it to rotate counter-clockwise, past 90, rotation and until the magnet 15 couples to the pad 14 to latch the disk in ON position on the soft iron pad.

Once the magnetic coupling near the ON position is sufficient to ensure latching, the current may be terminated until the time to switch the disk to OFF. Instead of a continuous pulse, during movement between OFF and ON intermittent pulsing may be used.

In the ON position of the disk the permanent magnet 15 has its one (here N) pole proximate the PCB and the relevant pixel path. Thus to switch the disk back to OFF position the current flow must be created in the path to produce a stator field with an opposite polarity to rotate the disk.

In FIG. 3 (solid line position) the rotor field RF and housing field SF are shown at the instant it is desired to switch from the ON or solid line position to OFF. In the ON position the field of magnet 15 has one (here pole N) directed toward the soft iron pad 14. (The soft iron pad in the absence of the current path field will couple equally well to one magnetic polarity or the other.) Current flow is initiated in path 20 to create a field opposite to that of the permanent magnet 15. The disk is repelled until it passes top dead centre (TDC) position after which the S pole of the permanent magnet directs its South poled field toward the then oppositely poled housing field and the disk is drawn into the OFF position, with its magnetic latching to pad 12 displaying its OFF side and PCB OFF area in the viewing direction.

The current in the path 20 causing the housing field may be turned off as soon as the magnet 15 magnetically couples to pad 12.

When it is desired to switch the disk and pixel to ON position the current is applied in the coil 20 to create a housing field, opposite to that of the rotor in ON position. Such housing field repels the magnet 15 and causes the disk to rotate from OFF to ON position until its permanent magnet couples to magnet 14, at which point it may turn off.

If necessary the strength of the housing field may be increased by the series connections paths in I the same sense on sub layers of the PCB (not shown).

I claim:

1. Changeable display element including an insulating board, said board having at least one layer with a surface, means on the surface on said layer for forming a conducting path, said path being shaped to form a magnetic field with a major component perpendicular to the board and in a sense determined by the current flow direction in said path, said path having no effective core a disk defining a median plane, said disk having ON and OFF sides of contrasting appearance, said disk being pivotally mounted adjacent to one edge on said board and swingable about said axis substantially parallel to the surface to display ON and OFF sides to be visible in a viewing direction in ON and OFF positions, respectively, a permanent magnet moveable with said disk and defining a rotor field with a polarity approximately transverse to said plane, said disk being responsive to one and the opposite polarities of said field to move from one of said ON and OFF positions toward the other, wherein said disk in each of said ON and OFF position respectively, exposes to be visible in a viewing direction, a board area on the other side of said axis from the disk corresponding to a similarly colored area on the displayed side of the disk.

2. An array of changeable display elements as claimed in claim 1 and means for selectively controlling the display elements in said array to produce a pattern from the combined element appearance.

3. Changeable display element as claimed in claim 1 wherein a low remanence magnetic pad is located on said board, corresponding to each of said ON and OFF positions and located to attract said permanent magnet thus tending to retain the element in its then ON or OFF position on said board.

4. Changeable display element as claimed in claim 2 where a low remanence magnetic pad is located on said board, corresponding to each of said ON and OFF positions and located to exert a force on said permanent magnet thus tending to retain the element in its then ON or OFF position on said board.

5. A combination comprising an insulating plate, a disk swingably mounted thereon, near one edge, located to rotate through approximately 180° between positions roughly parallel to said board to display contrasting ON and OFF sides in a viewing direction, wherein said disk in each ON and OFF positions respectively exposes to be visible in a viewing direction, a board area on the other side of said axis from said disk, approximately corresponding to a similarly colored area on the displayed side of the disk, means defining a current path on at least one surface of said plate, arranged whereby current along said path creates a magnetic field with a component transverse to the plate and in a sense determined by the current direction, said path being located to drive said disks between said ON and said OFF positions, there being effectively no core for said path.

6. In combination, a display disk contrastingly colored on opposite sides swingably mounted to rotate approximately 180° between ON and OFF positions each approximately parallel to said board, where opposed ON and OFF sides of the disk are respectively displayed to be visible in a viewing direction, in each position displaying a pixel comprising one of said sides and a similarly colored board surface area facing said viewing direction a permanent magnet movable with said disk defining a magnetic axis approximately transverse to said disk, means defining a current path on said board, said path being arranged so that current flowing therein will create a stator field approximately transverse to said disk responsive to current along said path, said path having no effective core, said path being located to allow said stator field to selectively drive said disk between ON and OFF positions.

7. A board having a surface, means defining a conducting path on said surface, said path being configured to create a field with a component perpendicular to said board and in a sense determined by the direction of current flow in said path, said path having no effective core, a disk swingably mounted on said board adjacent a disk edge, defining a rotation axis generally parallel to said board and to the median plane of said disk, said disk pivoting between ON and OFF positions respectively displaying an ON or OFF side to the viewing direction, said board being colored to complete a pixel with said ON side when the ON side is visible in the viewing direction, a permanent magnet mounted on said disk to create a rotor field with a component transverse to said disk, said path and said disk being located relative to each other so that said housing field drives said disk from one opposed ON and OFF position toward the other.

8. A combination as claimed in claim 5 wherein a soft iron pad is provided corresponding to each disk position, located to magnetically couple to the permanent magnet in one position and so restrain against movement of the disk to the other position.

9. A combination as claimed in claim 6 wherein a soft iron pad is provided corresponding to each disk position, located to magnetically couple to the permanent magnet in one position and so restrain against movement of the disk to the other position.

10. A combination as claimed in claim 7 wherein a soft iron pad is provided corresponding to each disk position, located to magnetically couple to the permanent magnet and so restrain against movement of the disk to the other position.

11. Method of operating a display element which is mounted near one edge on a board, and carries a permanent magnet, where current flowing along a path in said board can produce magnetic fields of polarity determined by current flow whereby a field of a selected polarity may magnetically interact with the field of said permanent magnet to move the display element between ON and OFF positions and where said magnet cooperates with magnetic pads at each of said ON and OFF positions, to tend, in the absence of a housing field, to retain the display element in one of said positions, the method of moving the display element from one of said ON and OFF positions to the other comprising the steps of:

providing current in said path in a sense to move said element from said one position to be other until said magnet magnetically couples to the pad at said other position.

12. Method as claimed in claim 11 wherein said current is intermittently applied to said display elements without allowing said element to cease rotation between limiting positions.

* * * * *